US005097733A

United States Patent [19]

Benkoski

[11] Patent Number: 5,097,733

[45] Date of Patent: Mar. 24, 1992

[54] APPARATUS AND METHOD FOR CUTTING CORDAGE AND THE LIKE

[75] Inventor: Robert J. Benkoski, Rutledge, Ga.

[73] Assignee: Wellington Leisure Products, Inc., Madison, Ga.

[21] Appl. No.: 723,411

[22] Filed: Jun. 28, 1991

[51] Int. Cl.[5] ..... B26D 7/06

[52] U.S. Cl. ..... 83/440.2; 83/856; 30/278; 30/290

[58] Field of Search ..... 30/290, 258, 283, 289, 30/286, 295, 282; 83/856, 440.2, 478, 860

[56] References Cited

U.S. PATENT DOCUMENTS

| | | | |
|---|---|---|---|
| 966,931 | 8/1910 | Le Massena | 30/296.1 |
| 967,303 | 8/1910 | Arnold | 30/290 |
| 1,128,663 | 2/1915 | Conness | 30/290 |
| 1,349,627 | 8/1920 | Peterson | 83/856 |
| 1,527,835 | 2/1925 | Burke | 30/290 |
| 1,795,394 | 3/1931 | Hirsch | 30/289 |
| 2,194,707 | 3/1940 | Locker | 30/290 |
| 2,321,881 | 6/1941 | Waelty | 83/857 |
| 2,730,800 | 1/1956 | Bailey | 30/286 |
| 4,708,044 | 11/1987 | Adams | 30/290 |
| 4,757,612 | 7/1988 | Peyrot | 30/286 |
| 4,873,767 | 10/1989 | Lok | 30/289 |
| 4,878,408 | 11/1989 | Isaacson et al. | 83/444 |
| 4,979,413 | 12/1990 | Beller | 83/444 |

*Primary Examiner*—Douglas D. Watts
*Assistant Examiner*—Hwei-Siu Payer
*Attorney, Agent, or Firm*—Kennedy & Kennedy

[57] ABSTRACT

An apparatus 10 for safely cutting cordage has central frame members 11 that defines a cord working space 17 in which a cutting blade 33 having an elongated cutting edge 34 is mounted. Spring biased blade guards 40 are mounted on each side of the blade which are movable between a position shielding the blade cutting edge and a position exposing the blade cutting edge. A length of cordage is manually cut by drawing it against the blade guards and forcing them from their blade edge shielding position to their blade edge exposing position and then drawing the cordage over the exposed blade edge.

5 Claims, 2 Drawing Sheets

APPARATUS AND METHOD FOR CUTTING CORDAGE AND THE LIKE

TECHNICAL FIELD

This invention relates to methods and apparatuses for cutting cordage.

BACKGROUND OF THE INVENTION

Elongated, usually flexible materials, such as cordage and the like, for many years has been cut with knifes. One typically cuts it by holding the cordage with one hand and cutting it with a knife in the other hand, or by forming a loop in the cordage and then slitting the loop bite. This method of cutting is fatiguing, for essentially all the work is preformed by only one hand. Cutting with knives in this manner has also proved to be dangerous for occasionally a knife will slip and wound the person.

Devices have been made which fixedly mount a cutting blade to a holder which in turn is mounted to a stationary support, such as a table. With these devices, the blade remains stable during the cutting process, thus decreasing the risk of injury. Exemplary of this type of device is that shown in U.S. Pat. No. 1,128,663. Though this type of device stabilizes the blade, the sharp edge of its blade is exposed, thus posing a potential threat to the safety of those working near it.

Other devices, such as that shown in U.S. Pat. No. 1,349,627, partially encase the blade. However, the blades of these devices remain somewhat exposed, even when not in use.

It thus is seen that a need remains for an apparatus and method for cutting cordage in an improved, less fatiguing and safer manner. Accordingly, it is to the provision of such that the present invention is primarily directed.

SUMMARY OF THE INVENTION

In a preferred form of the invention, an apparatus for safely cutting cordage and other elongated materials comprises a frame having a transverse opening therethrough. A blade is mounted to the frame with an elongated cutting edge positioned within the frame opening. A pair of side shields are mounted for movement straddling the blade between a position shielding the blade cutting edge and a position exposing the blade cutting edge. Spring means bias the blade guards towards their blade edge shielding position. With this construction cordage may be safely cut by drawing it against the side shields in their blade shielding position and forcing the shields to their blade exposing position. The cordage is then drawn over the blade until it is severed whereupon the side shields are returned by the spring means to their blade shielding position.

In another preferred form of the invention, a method of manually cutting cordage in a safe manner comprises the steps of grasping opposite ends of a length of cordage to be cut and forcing the length of cordage against a pair of movable shields that are positioned by spring means in a position shielding an elongated blade until the shields are forced to a position exposing the blade. The length of cord is then forced back and forth over the elongated blade until it is severed thereby permitting the shields to return to their blade shielding position.

DETAILED DESCRIPTION

Figure 1:
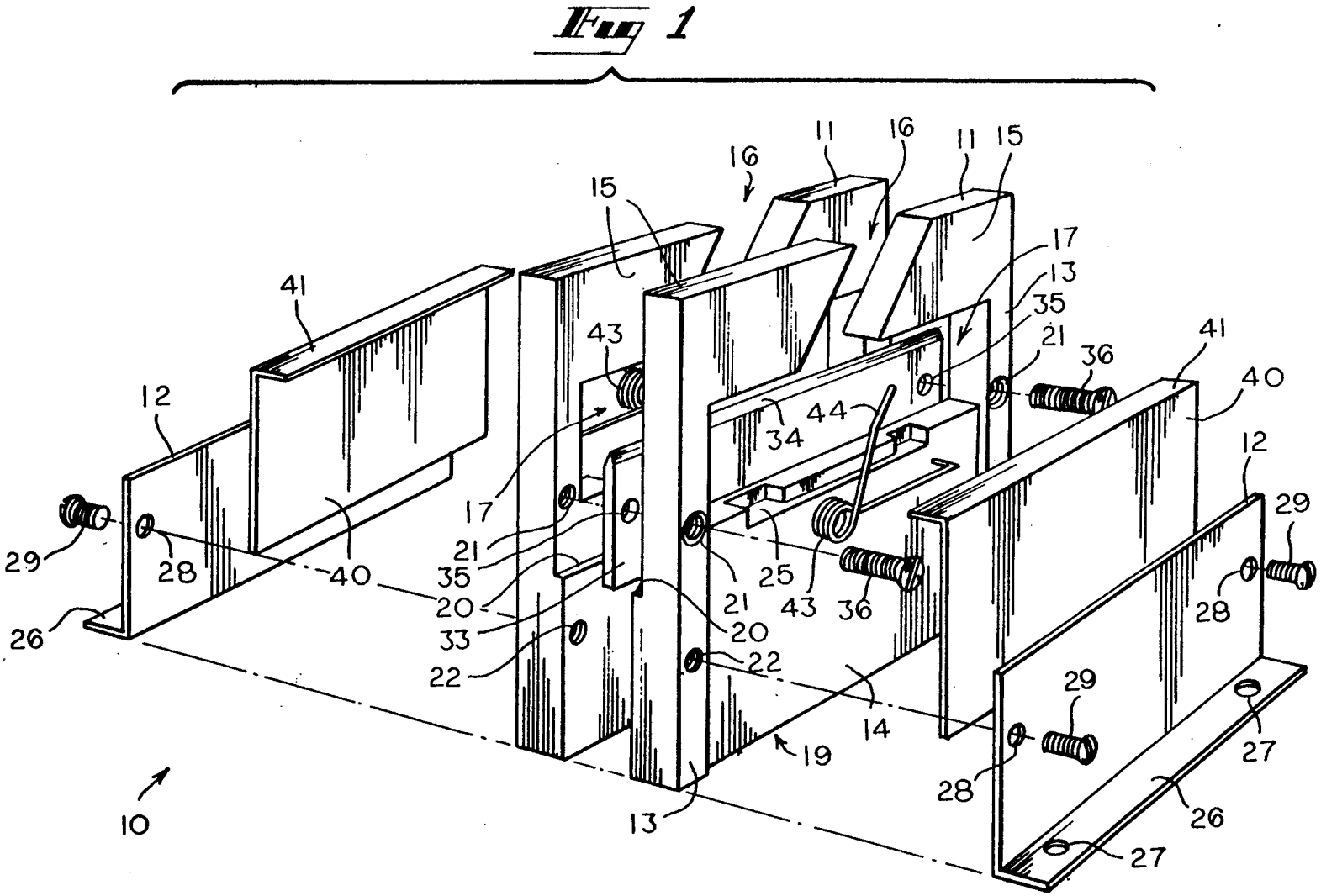
FIG. 1 is an exploded view of apparatus embodying principles of the invention in a preferred form.

With reference next to the drawings, there is shown an apparatus 10 having a housing comprising a pair of central frame members 11 of like construction, and a pair of side panels 12 of like construction. Each central frame member 11 has two end walls 13, a bottom wall 14 extending between the end walls, and a top wall 15 formed with a canted channel 16. The combination of these walls 13, 14 and 15 thus has a transverse opening therethrough which may serve as a cord working space 17. The front side of the bottom wall 14 is recessed slightly from that of the end walls 13 so as to form a small recess 19 between the end walls. An upper portion of the confronting back sides of the end walls and bottom wall is stepped back so as to form a ledge 20. Each end wall 13 has a countersunk, threaded, upper mounting hole 21 located above the ledge 20 and a threaded, lower mounting hole 22 located below the ledge. The top of the bottom wall 14, which defines the floor of the cord working space 17, is formed with a channel 25. Each housing side panel 12 has an outwardly turned mounting flange 26 formed with apparatus mounting holes 27. The side panels 12 also have two mounting holes 28, each aligned with a frame end wall lower mounting hole 22.

The apparatus also has a blade 33 with an upwardly facing, elongated cutting edge 34 and two mounting holes 35. Two blade guards 40 having in-turned flanges 41 are also provided as are two coil springs 43.

For assembly the blade 33 is positioned between the two frame members 11 so that as the frame members are brought together the blade is positioned atop the coplanar ledges 20 within a gap 32 formed between the members. Mounting bolts 36 are securely threaded through mutually aligned threaded upper mounting holes 21 and blade mounting holes 35 to secure the frame members to each other with the blade held therebetween. The springs 43 are mounted in channels 25. The blade guards 40 are positioned to each side of the blade 33 with the underside of their top flanges 41 bearing upon underlying spring extension arms 44. The side panels 12 are then mounted flush with the blade guards 40 and the end walls 13, and then secured to the end walls by passing mounting bolts 29 through mounting holes 28 and threading them into the threaded lower mounting holes 22.

Assembled in this manner, the main upright portion of the blade guards may travel vertically within recesses 19 between the frame bottom wall 14 and the side panels 12 with the guard flanges 41 traveling within the cord working space 17. The springs 43 bias the blade guards to the blade shielding position shown in FIG. 2A where their top flanges 41 abut the bottom side of the top wall where they substantially cover the blade cutting edge and an end of the channel 16. With the blade guards positioned in this manner an operator's fingers can not be cut by accidentally entering the cord working space 17 unless the operator actually depresses the guards. The blade guards are limited in downward movement by the engagement of their flanges 41 with the top of the bottom wall 14. The blade guards are prevented from moving from side to side by the end wall portions that define recess 19.

The apparatus may be fixedly mounted to a table or the like by passing mounting screws through flange mounting holes 27 and securing them into the underlying support. Although the apparatus is shown mounted to a horizontal surface it should be understood that it obviously may also be mounted to an inclined or even vertical surface. Thus reference to "vertical" herein is only for ease of explanation since the apparatus is not gravity sensitive.

Figure 2A:
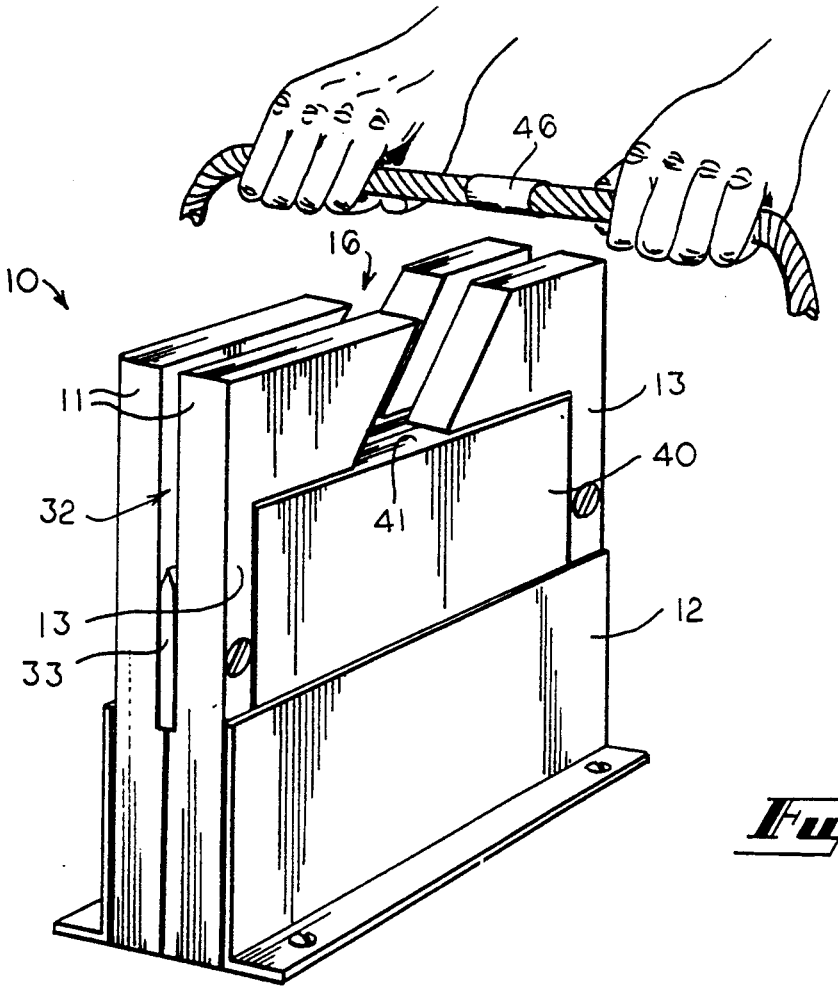
FIGS. 2A-2B are a sequence of views of the apparatus of FIG. 1 shown in use cutting a length of cordage.
Figure 2B:
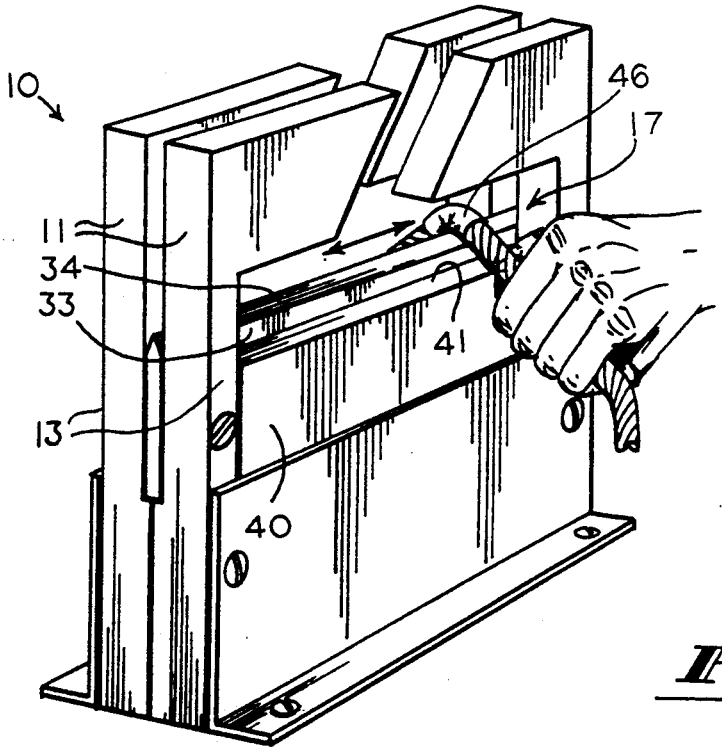

Operation of the apparatus may best be understood by reference to FIGS. 2A–2B. In FIG. 2A the apparatus is shown with its blade guards 40 in their blade shielding positions. A length of cordage is also shown having an adhesive strip 46 wrapped about a portion of the cordage to be cut which is done to prevent the cordage from any tendency to unraveling once it has been severed. The cordage is grasped by an operator with both hands such that the taped portion of the cordage is positioned between the operator's hands. To cut the cordage, the portion of the cordage between the operator's hands is passed through the canted channel 16 and into engagement with the blade guards top flanges 41. As the cordage is forced further down, it urges the blade guards downwardly against the biasing force of the springs 43 to their unshielded position shown in FIG. 2B. As the blade cutting edge 34 is now exposed, the taped portion of the cordage engages it. As shown in FIG. 2B, with continued downward pressure being applied to the cordage, the cordage is forced along the length of the blade cutting edge 34 in a back and forth fashion until it is severed. Once severed, the downward force placed upon the blade guards by the cordage is removed, which allows the springs 43 to return the blade guards 40 rapidly back to their initial blade shielding positions.

It should be noted that the blade guards in-turned flanges 41 also function to provide smooth, unabrasive surfaces for contact with the cordage to each side of the cut as the cordage is being cut. This serves to avoid the production of small nicks or cuts in the cordage during the cutting process which tends to fray the cut ends. The channel 16 is cantered so that fingers can not easily be moved into the space.

If desired, a reel of adhesive tape may be mounted to one end of the apparatus with the tape extending over a top portion of the apparatus to a serrated edge mounted beside the entrance to the channel 16.

From the foregoing it is seen that an apparatus and method for cutting cordage is now provided which overcomes problems long associated with those of the prior art. It should however by understood that the just described embodiment merely illustrates principles of the invention is a preferred form. Many modifications, additions and deletions may, or course, by made thereto without departure from the spirit and scope of the invention as set forth in the following claims.

I claim:

1. Apparatus for safely cutting cordage and other elongated materials comprising, in combination, a frame at least partially defining a transverse opening therethrough, said frame having a top wall defining an upper boundary of said transverse opening; a blade mounted to said frame with an elongated cutting edge positioned within said frame opening; a pair of side shields mounted for movement straddling said blade between a position shielding said blade cutting edge and a position exposing said blade cutting edge and spring means biasing said side shields towards said blade edge shielding position, whereby cordage may be safely cut by drawing it against the side shields in their blade shielding position and forcing the shields to their blade exposing position, and drawing the cordage over the blade until it is severed whereupon the side shields are returned by the spring means to their blade shielding position, and wherein said side shields have in-turned top flanges that may engage said frame top wall under the bias provided by said spring means.

2. The apparatus of claim 1 wherein said frame top wall has a channel therethrough canted with respect to said elongated cutting edge.

3. The apparatus of claim 1 further comprising a pair of side panels rigidly mounted to said frame beside said pair of side shields.

4. Apparatus for cutting cordage comprising a frame; a blade rigidly mounted to said frame and having an elongated cutting edge along which cordage may be manually reciprocated and cut; a pair of side shields mounted to said frame for movement beside said blade between positions shielding and exposing said blade elongated cutting edge; and spring means biasing said side shields towards said blade shielding position, and wherein a portion of said frame extends over said blade cutting edge and is formed with a channel through which cordage may be passed into contact with said side shields, and wherein said side shields are biased by said spring means into engagement with said frame portion.

5. The apparatus of claim 4 wherein said side shields are formed with in-turned flanges that substantially completely block an end of said frame portion channel with said side shields biased against said frame portion.

* * * * *